United States Patent [19]

Kaeser

[11] 4,025,782

[45] May 24, 1977

[54] POLE AND DEVICE FOR RAISING AND LOWERING LIGHTING FIXTURES THEREON

[75] Inventor: Robert E. Kaeser, Cincinnati, Ohio

[73] Assignee: LCA Corporation, Bala Cynwyd, Pa.

[22] Filed: Feb. 24, 1976

[21] Appl. No.: 660,759

[52] U.S. Cl. ..... 240/64; 240/84

[51] Int. Cl.[2] ..... F21V 21/36

[58] Field of Search ..... 240/64, 67, 84, 63, 240/65, 72, 73

[56] References Cited

UNITED STATES PATENTS

| | | | |
|---|---|---|---|
| 3,686,498 | 8/1972 | Meyer | 240/84 |
| 3,949,842 | 4/1976 | Kiehn | 240/64 X |
| 3,958,116 | 5/1976 | Jones | 240/67 |

*Primary Examiner*—John Gonzales
*Attorney, Agent, or Firm*—Seidel, Gonda & Goldhammer

[57] ABSTRACT

A pole or mast is disclosed having lighting fixtures at the upper end thereof and means for raising and lowering the lighting fixtures by a cable. The pole is constructed so that it may receive and temporarily support a portable device having a motorized winch for raising and lowering the lighting fixtures. By having the winch on the portable device, it is not necessary to have a winch inside each pole.

7 Claims, 7 Drawing Figures

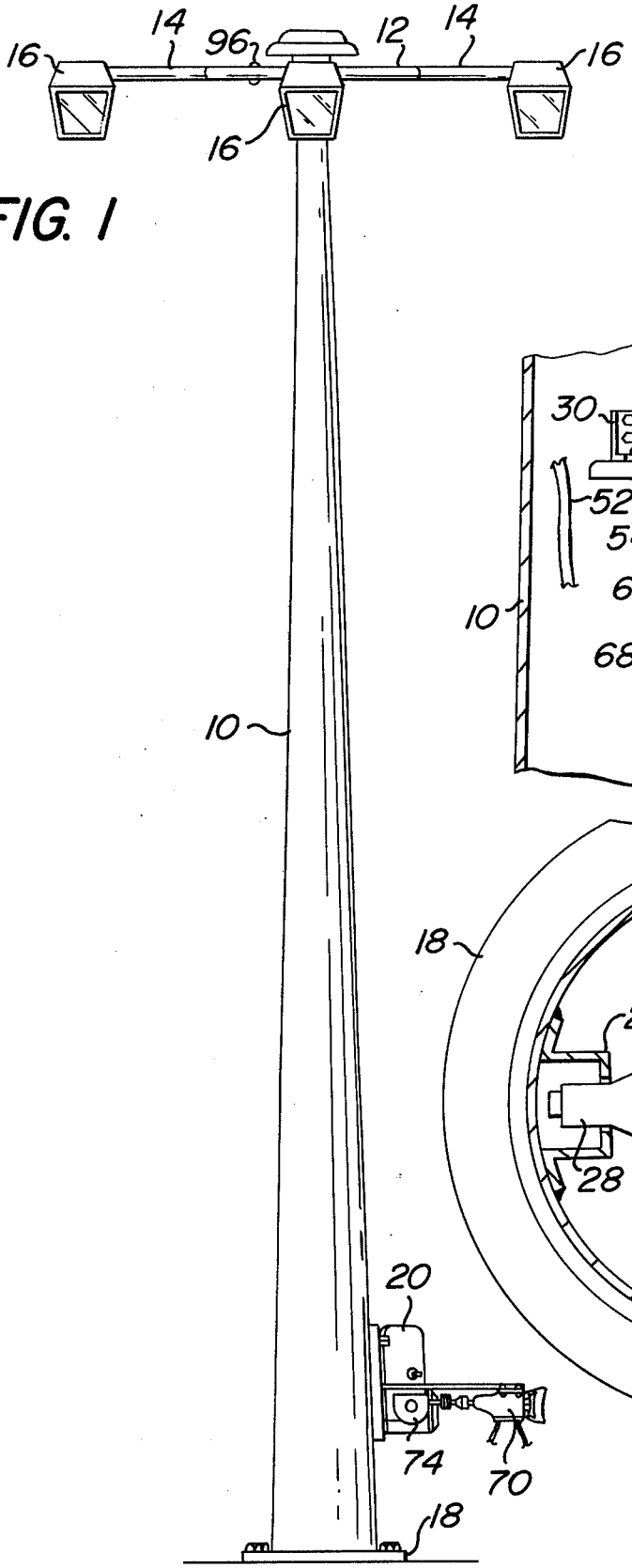
FIG. 1
FIG. 4
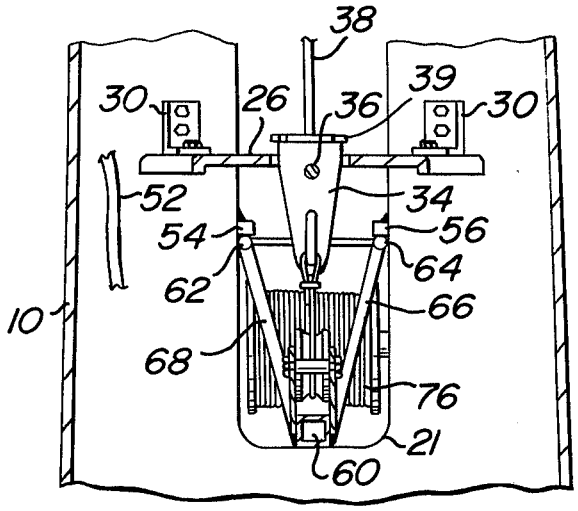
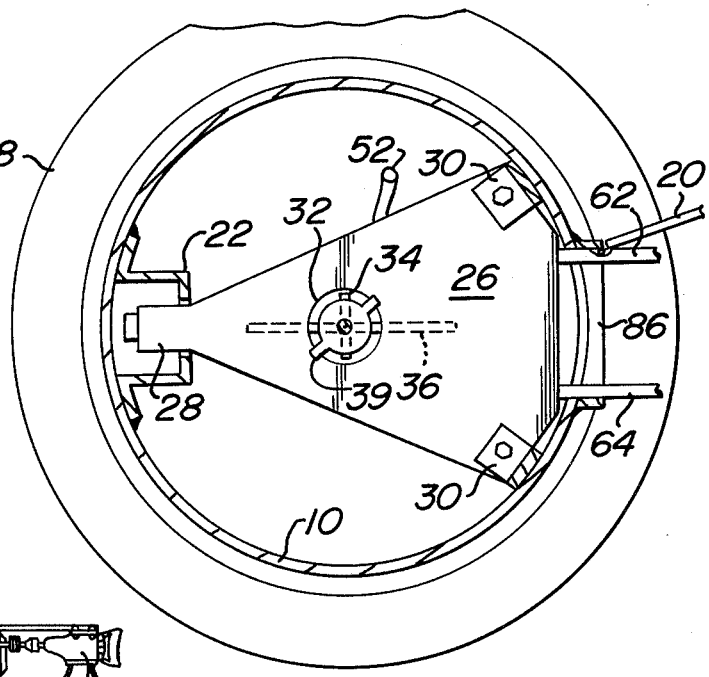
FIG. 5

POLE AND DEVICE FOR RAISING AND LOWERING LIGHTING FIXTURES THEREON

BACKGROUND

In class 240, there are a large number of patents dealing with poles having lighting fixtures capable of being raised or lowered by cable. The present invention reduces the cost and maintenance of such structures by eliminating components, moving parts, whereby the pole may be less expensive and have less wind loading at the top of the pole.

The present invention is directed to a pole having a frame at the top of the pole. The frame supports a plurality of light fixtures. One or more cables are connected to the frame and extend from the frame over a pulley at the top of the pole and downwardly through the pole.

An anchor is connected to the lower end of the hoisting cable within the pole. A locking means within the pole prevents the anchor from moving upwardly which would result in the frame moving downwardly from the upper end of the pole. The pole is provided with a movable door adjacent the elevation of the anchor. Bracket means are provided inside the pole opposite the door for receiving one end of a portable device for effecting a lowering of the frame. A limit stop means is provided adjacent the door for contacting an upper surface on such portable device and for counteracting reaction forces on such portable device. The anchor has means thereon to which a cable and winch on the portable device may be selectively connected to raise and lower said frame relative to said pole.

It is an object of the present invention to provide a novel pole and lighting fixture.

It is an object of the present invention to provide a novel portable device for raising and lowering a frame and lighting fixture at the top of a pole.

It is another object of the present invention to provide a pole structurally interrelated in a manner whereby the cost of installation and maintenance may be reduced.

Other objects will appear hereinafter.

For the purpose of illustrating the invention, there is shown in the drawings a form which is presently preferred; it being understood, however that this invention is not limited to the precise arrangements and instrumentalities shown.

FIG. 1 is an elevation view of a pole in accordance with the present invention.

FIG. 4 is a sectional view taken along the line 4—4 in FIG. 3.

FIG. 5 is a sectional view taken along the line 5—5 in FIG. 3.

Figure 3:
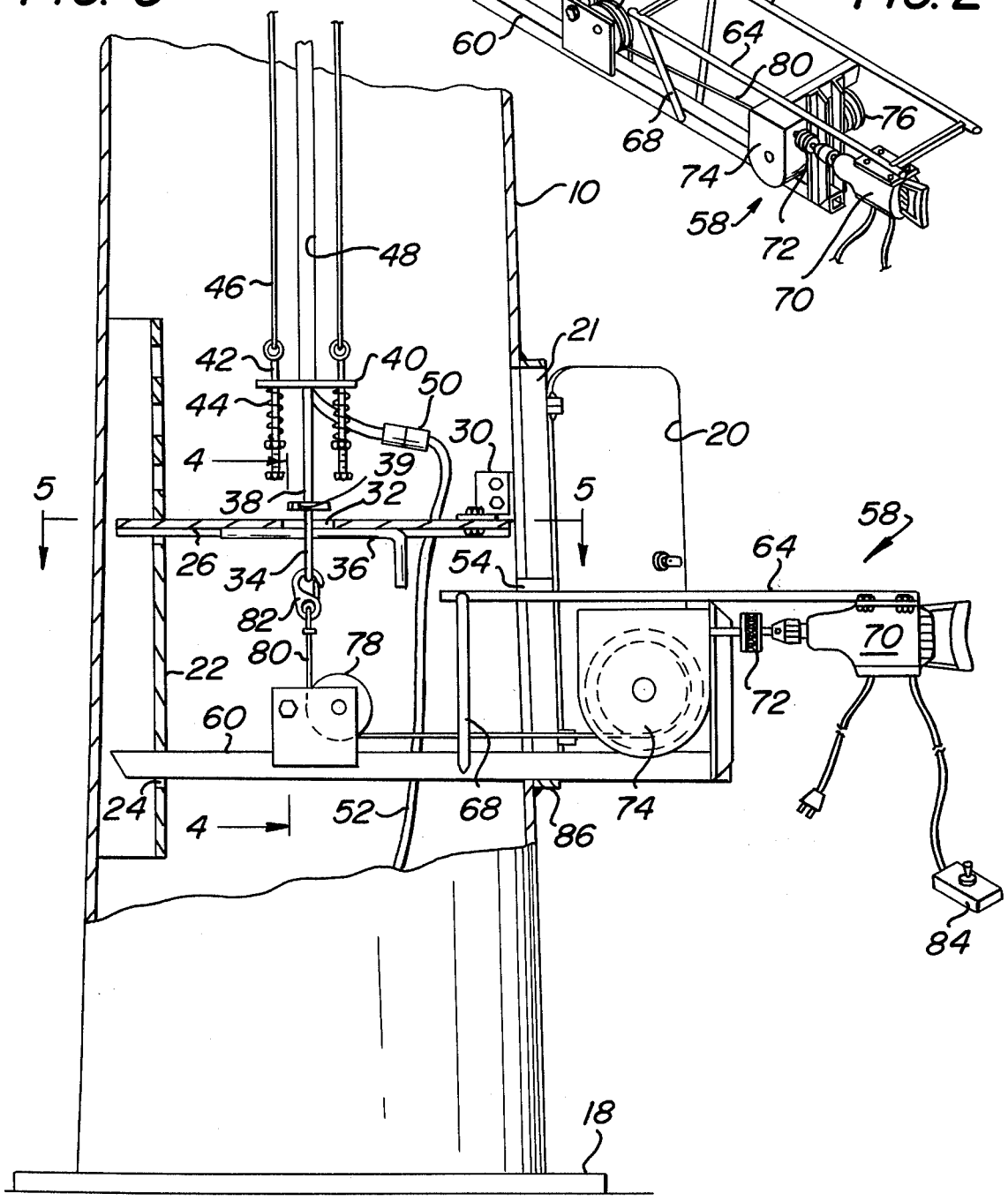
FIG. 3 is an enlarged partial sectional view of the base portion of the pole in FIG. 1.

Referring to the drawing in detail, wherein like numerals indicate like elements there is shown in FIG. 1 a pole 10 having a ring-like frame 12 supported at its upper end. The frame 12 has a plurality of radially outwardly directed projections 14 each of which supports a lighting fixture 16.

Referring to FIG. 3, adjacent the base 18 of the pole 10 there is provided an opening 21 which is selectively closed by door 20 having a lock thereon. A bracket 22 is fixedly secured within the pole diametrically opposite the opening 21. See FIG. 5. Bracket 22 has an opening 24 adjacent its lower end as shown in FIG. 3. The purpose of opening 24 will be made clear hereinafter.

A transverse support member 26 is supported in a horizontal disposition within the pole 10. Member 26 has a nose portion 2 which is received in one of a plurality of openings on the bracket 22. The end of the number 26 remote from the nose 28 is removably secured to brackets 30 on the inner surface of the pole 10 or in the alternative on the flange surrounding opening 21. The pole has a series of holes each of which is adapted to facilitate changing the elevation of the brackets 30 whereby the elevation of the member 26 is selectively adjustable within the pole 10.

Member 26 has a hole 32 in the center thereof. An anchor plate 34 partially extends upwardly through the holes 32 and is connected to a rod 38 having limt stop 39 thereon. The anchor plate 34 has a hole transversely therethrough which receives a locking pin 36. The locking pin 36 contacts the bottom surface on the member 26 and thereby prevents the anchor plate 34 from moving upwardly.

The upper end of the rod 38 is connected to a mounting plate 40. A plurality of bolts 42 extend through the mounting plate 40 and terminate at their upper end in a loop. Each loop is connected to one end of a discrete hoisting cable 46. A spring 44 surrounds each bolt 42 at a location below the plate 40. An adjustable nut on bolt 42 adjusts the tension of the spring 44. Rod 38 is preferably provided with indicia opposite the area of the springs 44 to provide an indication of tension.

Thus, it will be seen that each hoisting cable 46 is connected to a bolt 42 which transmits its load to the mounting plate 40 by of the springs 44. Plate 40 transmits its load by way of rod 38 to the anchor plate 34 which in turn transmits its load to the transverse member 26 by the removable pin 36.

Power to the lighting fixture 16 is transmitted thereto by way of a power cable 48. Power cable 48 is connected to a power supply cable 52 by way of a separable coupling 50. Supply cable 52 extends to one side of the transverse member 26. Mounting plate 40 is provided with a clamp for guiding the lower end of the power cable 48.

The opening 21 is provided with fixed limit stops 54 and 56 on opposite sides thereof. See FIG. 4. The purpose of the limit stops 54, 56 will be made clear hereinafter.

Figure 2:
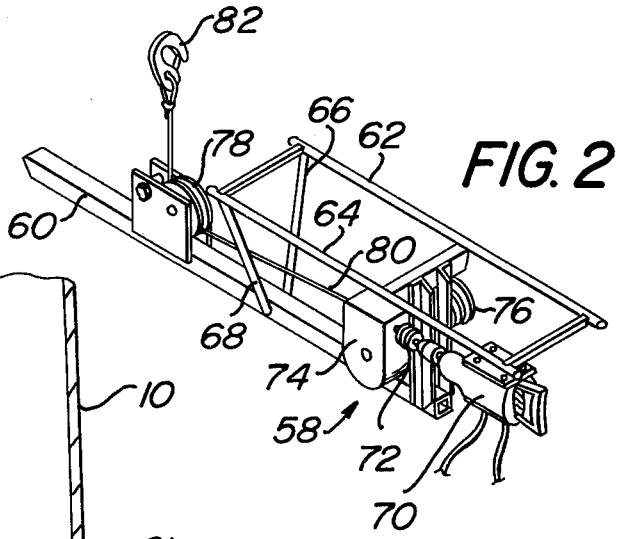
FIG. 2 is a perspective view of a portable device for use with the pole illustrated in FIG. 1.

A portable hoisting tool 58 is provided for use with the pole 10. See FIG. 2. The tool 58 includes a longitudinally extending base 60 wich is preferably hollow andrectangular in cross section. The base 60 supports side frame members 62 and 64 which are parallel to the base 60 and supported therefrom by struts 66 and 68. The frame members 62 and 64 are spaced apart by a distance greater than the width of the base 60 whereby the struts 66 and 68 extend upwardly and outwardly.

A motor 70, preferably provided with a pistol grip is supported by side frame member 64. Motor 70 is connected by way of torque limitor 72 to a winch 74 having a drum 76. Cable 80 is wound on the winch take-up drum 76 and extends around idler pulley 78 supported by the base 60. Cable 80 terminates in a hook 82. Hook 82 is selectively connected to plate 34 through a hole in the anchor plate 34.

The motor 70 is provided with a remote actuator switch 84 of the type which may be stepped on with a foot whereby the operator's hands are free of other activity. At the bottom of the opening 21, there is provided a horizontally disposed ledge 86 for supporting the tool 58 when the forward end of the base 60 has been inserted into the opening 24.

Figure 6:
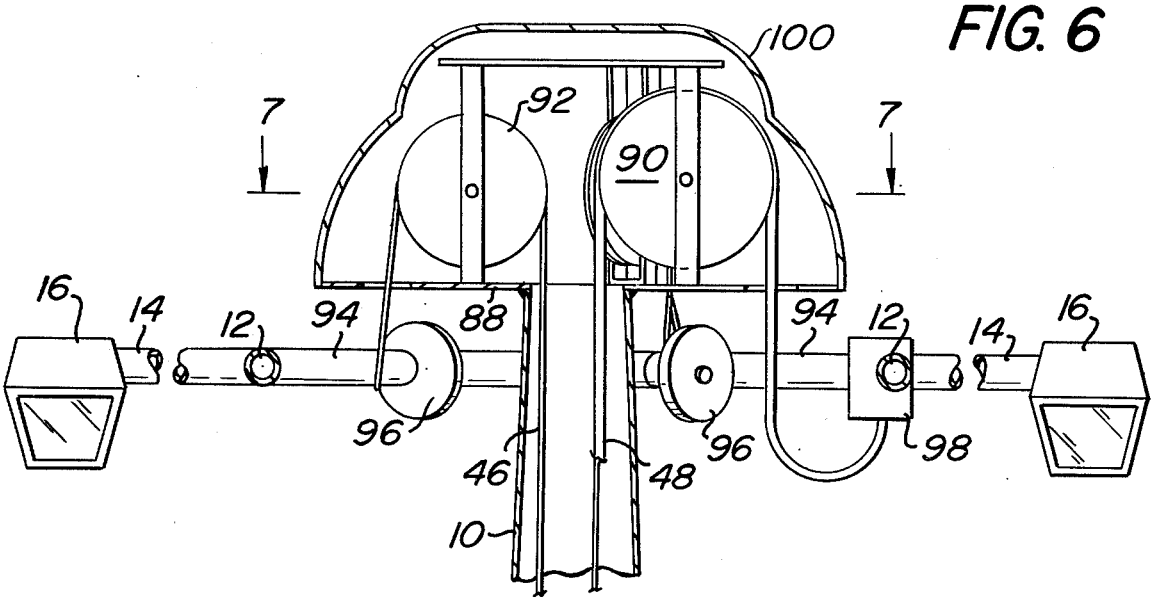
FIG. 6 is a vertical sectional view of the upper end of the pole in FIG. 1 but on an enlarged scale.
Figure 7:
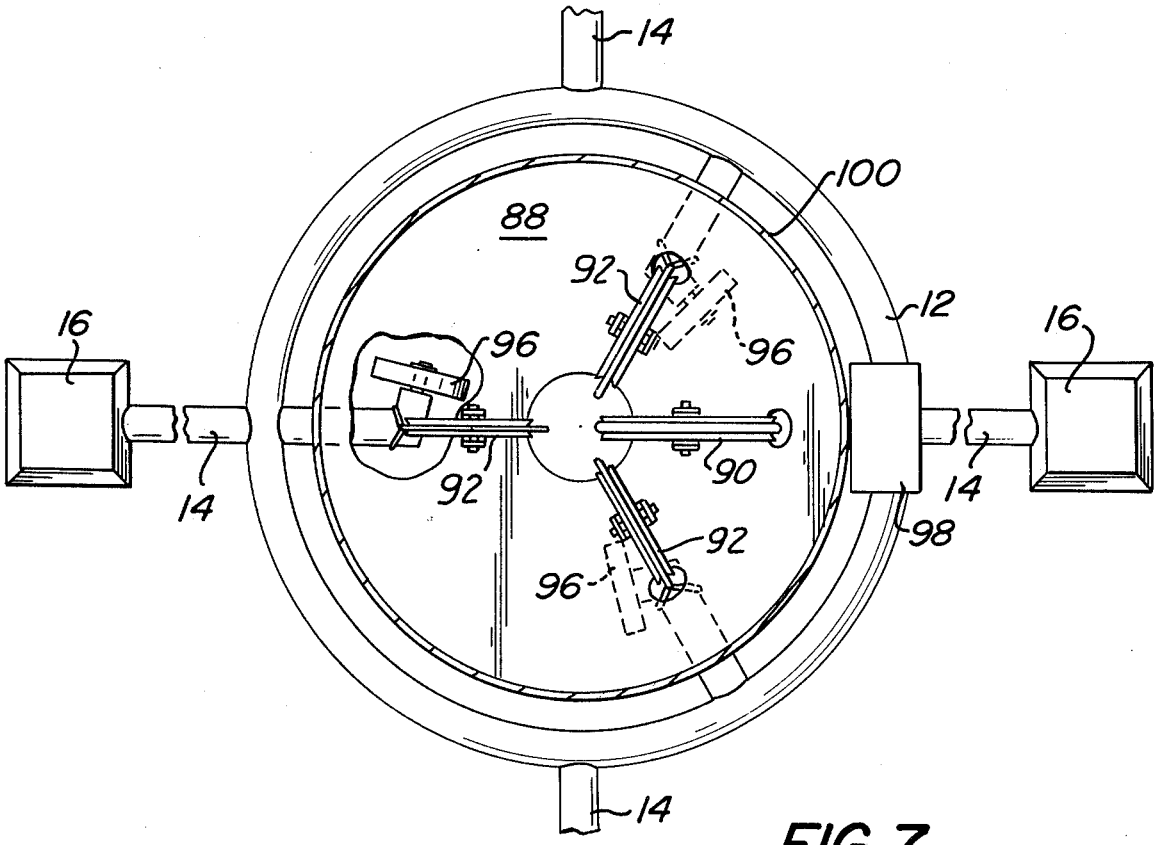
FIG. 7 is a sectional view taken along the line 7—7 in FIG. 6.

Referring to FIG. 6, a horizontally disposed support plate 88 is fixedly secured to the upper end of the pole 10. Plate 88 rotatably supports a power supply pulley 90 around which the power supply cable 48 extends. Plate 88 also supports one hoist cable pulley 92 for each of the hoisting cables 46. In a preferred embodiment of this invention, there are three hoisting cables 46.

The ring frame 12 has a plurality of radially inwardly directed arms 94 each terminating in a roller 96. There are preferably at least three such arms. Each roller 96 may be a discrete roller or a pair of rollers. Arm 94 extends radially inwardly from the ring frame 12 for a sufficient distance so that its free end adjacent the roller 96 is in a location so that the hoisting cable 46 may be attached thereto. It will be noted that each hoisting cable 46 extends around only a single pulley 92 at the upper end of the pole 10.

The power cable 48 extends to a wiring box 98 supported by the ring frame 12. Ring frame 12 is hollow whereby conductors may extend therethrough to the various projections 14 which are likewise hollow to thereby couple power to the lighting fixture 16. A weather cover 100, open at its bottom, is supported by the plate 88 and overlies the plate 88 enclosing the pulleys 90, 92. Appropriate holes are provided in the support plate 88 through which the cables 46, 48 extend.

It will be noted that there are minimum number of moving parts at the upper end of the pole 10. Likewise, there are a minimum number of mechanical components and moving parts at the base of the pole 10. It will be noted that the base of the pole 10 does not include a winch for operating the hoisting cables 46. In order to raise or lower the lighting fixture 16 for installation and/or maintenance it is necessary to have a tool 58. Tool 58 is used to lower the lighting fixture 16 as follows.

With a key, the door 20 is opened. The tool 58 is inserted through the opening 21 until the forward end of the base 60 is received in the opening 24. The base rests on the ledge 86. Limit stop 54 contacts the upper surface of the side frame member 62. Limit stop 56 engages the upper surface on the side frame member 64. Hook 82 on the cable 80 is connected to the anchor plate 34.

The reversable motor 70 is first operated in a direction to pull down on the anchor plate 34 until limit stop 39 contacts member 26. This relieves the pressure on pin 36 which is then pulled until it is removed from the hole in the anchor plate 34. Thereafter, motor 70 is reversed so as to cause the winch 74 to pay out cable 80 from drum 76. As cable 80 is paid out, anchor plate 34 and hook 82 move upwardly through the hole 32 in member 26. Power cables 48 and 52 will have been separated at the coupling 50.

As the hoisting cables 46 and drum cable 80 move upwardly within the pole 20, the ring frame 12 and the lighting fixture 16 thereon descend. Swaying of the ring frame 12 is prevented by the rollers 96 which are preferably rubber covered so as to prevent marring of the outer surface of pole 10. While the winch 74 bears the weight of the ring frame 12, it is transmitted by way of the frame of the took 58 to the limit stops 54, 56 and the bracket 22. When it is desired to raise the ring frame 12, the above sequence of steps is repeated.

A single tool 58 may be utilized to service a large number of poles 10. Since only a single hoisting cable pulley 92 is provided for each hoisting cable 46 at the upper end of the pole 10, and since the winch, pulleys and other structure has been eliminated from within the base of the pole 10, the cost of the pole 10 has been reduced. By minimizing the number of moving parts, there is less wear on the cable. Inspection and service is readily attained only by authorized personnel having a tool 58. Because there are no moving parts in the form of a winch, motor, gear box, or drum assembly permanently installed in the base of the pole 10, the diameter side of the base of the pole 10 can be reduced thereby reducing the cost and foundation requirements. Tension on the hoisting cables 46 is adjustable to a predetermined preload which is easily adjusted and can be visually checked through the opening 21. The use of a steel pin 36 provides a foolproof, postive, safe means for holding the ring frame 12 in its uppermost position. Member 26 is preferably adjustable and aids in the stringing and erecting of the pole 10. Such adjustment is useful if the hoisting cables 46 stretch after the pole is erected.

During the above-described operation, it is to be noted that the entire system is stressed to a maximum point by pulling down on the anchor plate 34 while the ring frame 12 is still safely held in place by the pin 36. Should a failure occur at this point in time, the ring frame 12 is still positively held in a manner so that it cannot descend. Only after this safety check, can the pin 36 be removed and the ring frame 12 lowered. At no other time during the raising and lowering of the ring 12 does the load on the system approach the magnitude attained when the anchor plate 34 is pulled downwardly to facilitate removal of pin 36.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising a pole, a frame at the top of the pole, at least one light fixture on said frame, at least one hoisting cable extending from said frame over a pulley at the top of the pole and downwardly through the pole, an anchor connected to the lower end of said cable, releasable locking means in said pole for preventing said anchor and hoisting cable from moving upwardly, a movable door on said pole adjacent the elevation of said anchor, bracket means inside said pole opposite said door for receiving one end of a portable device for lowering said frame, limit stop means adjacent said door for contacting an upper surface of such a device and for counteracting reaction forces on such a device during lowering of said frame, said anchor having means to which a cable and winch on the portable device may be selectively connected to raise and lower said frame after release of said locking means.

2. Apparatus in accordance with claim 1 wherein said frame includes only one pulley for each hoisting cable, said frame including a ring which is hollow for receiving electrical conductors, a radially inwardly projecting arm on said ring for each hoisting cables each hoisting cable being connected adjacent a free end of one of said arms.

3. Apparatus in accordance with claim 1 including a transverse support member within said pole, said member having a hole through which said anchor may extend, said locking means selectively preventing said anchor from moving upwardly through said hole.

4. Apparatus in accordance with claim 3 wherein said bracket means adjustably accommodates said member at different elevations within said pole.

5. Apparatus in accordance with claim 1 including a portable device insertable through the door opening for contact with said bracket means and said limit stop means, said portable device including a motor operated winch and take-up drum, a cable on said drum, said drum cable terminating in a hook adapted to be removably connected to said anchor whereby said frame may be lowered by way of said hoisting cable and said drum cable as the drum cable is unwound from said winch drum.

6. Apparatus in accordance with claim 5 wherein said device has contact surfaces thereon for contact with said limit stops and positioned intermediate the forward end of said device and the location of the winch drum with the winch drum being disposed outside of said pole.

7. Apparatus in accordance with claim 5 wherein said portable device includes an idler pulley supported on said device adjcent the longitudinal axis of said pole

* * * * *